US006416173B2

(12) United States Patent
Kishida et al.

(10) Patent No.: US 6,416,173 B2
(45) **Date of Patent: *Jul. 9, 2002**

(54) CAPPED LIQUID CONTAINER AND A CAP

(75) Inventors: Hajime Kishida, Tokyo; Kenta Udagawa, Kawasaki; Osamu Sato, Chigasaki, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/025,749

(22) Filed: Feb. 18, 1998

(30) Foreign Application Priority Data

Feb. 19, 1997 (JP) ..... 9-034836
Jan. 23, 1998 (JP) ..... 10-011381

(51) Int. Cl.[7] ..... B41J 2/175; B65D 53/00; B65D 17/34

(52) U.S. Cl. ..... 347/86; 215/341; 220/378; 220/359.2

(58) Field of Search ..... 347/84–86, 29; 222/542; 215/341, 45; 220/378, 359.1, 359.2, 359.4, 212.5

(56) References Cited

U.S. PATENT DOCUMENTS

| | | | | |
|---|---|---|---|---|
| 3,247,992 A | * | 4/1966 | Exton | 215/45 |
| 3,428,208 A | * | 2/1969 | Kosar | 215/341 |
| 4,723,678 A | | 2/1988 | Kollen et al. | 215/347 |
| 4,760,409 A | * | 7/1988 | Kiyohara et al. | 347/86 |
| 5,405,032 A | | 4/1995 | Anderson | 215/252 |
| 5,692,646 A | | 12/1997 | Ota et al. | 222/105 |
| 5,806,718 A | | 9/1998 | Ota et al. | 222/105 |
| 5,816,449 A | | 10/1998 | Tanno et al. | 222/105 |
| 5,850,475 A | | 12/1998 | Kasao | 382/173 |
| 6,216,906 B1 | * | 4/2001 | Koshikawa et al. | 220/359.2 |

FOREIGN PATENT DOCUMENTS

| | | |
|---|---|---|
| FR | 832172 | 9/1938 |
| JP | 63-276554 | 11/1988 |
| JP | 8-30787 | 2/1996 |
| JP | 8-143062 | 6/1996 |

* cited by examiner

*Primary Examiner*—Judy Nguyen
(74) *Attorney, Agent, or Firm*—Fitzpatrick, Cella, Harper & Scinto

(57) ABSTRACT

A capped liquid container comprises a liquid container for retaining liquid, having a supply opening formed for supplying the liquid to the recording devices of an ink jet recording apparatus, and a cap fixed to the liquid container for closing the supply opening, the cap being removed from the liquid container by rotating the cap. This cap is formed by a rigid member and an elastic member, and the elastic member is provided with a first engagement portion, while a second engagement portion is formed on the edge circumference of the supply opening to engage with the first engagement portion. Then, the first engagement portion and the second engagement portion are sealingly pressed together, and at the same time, a part of the rigid member of the cap is fixed to the liquid container. With the structure thus arranged, the contact surface between the first and second engagement portions produces the sealing effect, hence making it possible to fabricate a capped liquid container having a high water tightness and air tightness. Further when the liquid container is unsealed, it is easy to open the liquid container without causing liquid to spread externally with the provision of the rigid member to the cap which prevents the container from being passed inwardly when being unsealed.

15 Claims, 17 Drawing Sheets

CAPPED LIQUID CONTAINER AND A CAP

BACKGROUND OF THE INVENTION

1. Field of the Invention

The present invention relates to a capped liquid container that retains liquid to be supplied to the recording devices of an ink jet recording apparatus. The invention also relates to a cap.

2. Related Background Art

The liquid used as a recording liquid for an ink jet recording apparatus is retained in a liquid container. The liquid container is unsealed when new recording liquid should be filled into an ink jet recording apparatus. Then, the liquid retained in the liquid container is ready to use. Here, in conjunction with FIG. 19, the description will be made of the conventional liquid container with a cap attached to it for use of an ink jet recording apparatus.

FIG. 19 is a cross-sectional view which shows the conventional liquid container with a cap attached to it. As shown in FIG. 19, the conventional liquid container having the cap attached to it is provided with a supply opening 102 on the liquid container 101 serving as a container to retain liquid in it. An elastic plate member 104 is pressed from outside the container by means of a cap external member 105 so that it abuts upon this supply opening 102, thus sealing the liquid container 101 to retain liquid inside the container. The cap external member 105 is arranged to extend vertically along both sides of the container from both edges of the surface. The elastic plate member 104 is then pressed to abut upon the supply opening 102. On each face of the leading ends of the cap external member, which is in contact with the liquid container, the click nail 106 is formed. Also, grooves are formed on the side faces of the liquid container 101 to engage with the click nails 106, respectively. In this manner, with the elastic plate member 104 sandwiched between the supply opening 102 and the cap external member 105, the click nails 106 are caused to engage with the grooves of the liquid container 101, thus hooking the cap external member 105 to the liquid container 101. Now, the liquid container 101 will be described further in detail.

FIGS. 20A and 20B are cross-sectional views which illustrate the liquid container 101 represented in FIG. 19. FIG. 20A shows the entire body of the liquid container 101. FIG. 20B is an enlarged view of the supply opening shown in FIG. 20A. As shown in FIG. 20A, the supply opening 102 extrudes from one face of the liquid container 101. The leading end of the extruded supply opening 102 has an acutely angled portion 107 as shown in FIG. 20B. The elastic plate member 104 is pressed to abut upon this acutely angled portion 107 at the leading end of the supply opening 102. Then, the acutely angled portion 107 is arranged to bite in the elastic plate member 104 to produce the sealing effect on the contact surface between the supply opening 102 and the elastic plate member 104. Thus, the liquid container 101 is sealed to retain liquid 103 in it.

However, if the water tightness and air tightness should be made higher for the conventional liquid container with the cap attached to it, there is a need for the enhancement of pressure exerted by the elastic plate member on the supply opening of the liquid container. When the pressure is increased, the stress is exerted more on the cap external member which is pressed to abut upon the elastic plate member. This stress causes the creep deformation of the cap external member, resulting in the reduction of the contact area between the supply opening and the elastic plate member. There is a possibility that the water tightness and the air tightness of the liquid container are lowered after all.

Also, if more stress is exerted on the cap external member to press the elastic plate member, a greater external force is needed to remove the cap external member from the liquid container. There is a fear that the operativity becomes unfavorable in this respect.

Further, when the click nails of cap external member should be disengaged from the grooves of the liquid container for the removal of the cap external member from the liquid container, an external force may be given so that the side faces of the liquid container are pressed inwardly in some cases. In such a case, the liquid container is to be unsealed while pressure is being exerted in the interior of the liquid container. As a result, there is a fear that the moment the liquid container is open, liquid in the liquid container is allowed to spread.

SUMMARY OF THE INVENTION

The present invention is designed with a view to solving the problems existing in the conventional art. It is an object of the invention to provide a capped liquid container whose cap that closes the supply opening formed for the liquid container has a lesser degree of creep deformation or the like and provides a higher water tightness and air tightness when recording liquid or the like is retained in the liquid container for use of an ink jet recording apparatus.

Also, it is another object of the invention to provide a capped liquid container having a good operativity to open the liquid container easily without allowing liquid retained in it to spread when the liquid container is unsealed.

In order to achieve the objects described above, the capped liquid container of the present invention comprises a liquid container retaining liquid, having a supply opening formed for supplying the liquid to the recording devices of an ink jet recording apparatus; and a cap fixed to the liquid container for closing the supply opening, the cap being removed from the liquid container by rotating the cap. This cap is formed by a rigid member and an elastic member, and the elastic member is provided with first engagement means, and second engagement means is formed on the edge circumference of the supply opening to engage with the first engagement means. Then, the first engagement means and the second engagement means are pressed to be joined together, and at the same time, a part of the rigid member of the cap is fixed to the liquid container.

Also, in order to achieve the objects described above, the cap of the present invention is arranged to close a liquid container. This cap is fixed to the supply opening of the liquid container for supplying liquid retained in the liquid container to the recording devices of an ink jet recording apparatus. The cap is formed by a rigid member and an elastic member. Then, first engagement means which is provided for the elastic member is pressed to join second engagement means which is provided for the supply opening, and at the same time, a part of the rigid member of the cap is fixed to the liquid container.

Further, the liquid container of the present invention is arranged to retain liquid, having a supply opening formed for supplying the liquid to the recording devices of an ink jet recording apparatus. Then, a cap is fixed to the supply opening for closing the liquid container, and removed from the liquid container by rotating the cap. Also, the supply opening is provided with second engagement means to engage with first engagement means provided for this cap. The second engagement means is pressed to join the first engagement means.

As described above, a capped liquid container of the present invention comprises a liquid container having a supply opening formed for it; and a cap fixed to the liquid container for closing the supply opening airtightly. The cap is removed from the liquid container when it is rotated to unseal the capped liquid container. The cap is formed by a rigid member and an elastic member. First engagement means is provided for the elastic member, and second engagement means is provided for the edge circumferential portion of the supply opening to engage with the first engagement means. The first and second engagement means are pressed to be joined together. At the same time, a part of the rigid member of the cap is fixed to the liquid container. In this manner, the elastic first engagement means is deformed to agree with the compressed shape of the contact surface of the second engagement means, thus the contact surface between the first and second engagement means produces the sealing effect to close the liquid container. Also, a part of the rigid member of the cap is fixed to the liquid container, thus making it difficult to cause creep deformation even when stress is exerted on the rigid member by the pressurized contact between the first and second engagement means. As a result, there is no possibility to spoil the sealing effect produced by the contact surface between the first and second engagement means. Further, when the capped liquid container thus structured is unsealed, the cap fixed to the liquid container is removed by the application of shearing force exerted by the rotation of the cap. Therefore, no external force is given to side faces of the liquid container when the cap is open. There is no possibility that liquid in the interior of the liquid container is caused to spread.

DETAILED DESCRIPTION OF THE PREFERRED EMBODIMENTS

Now, hereinafter, with reference to the accompanying drawings, the description will be made of the embodiments in accordance with the present invention.

(First Embodiment)

Figure 1A:
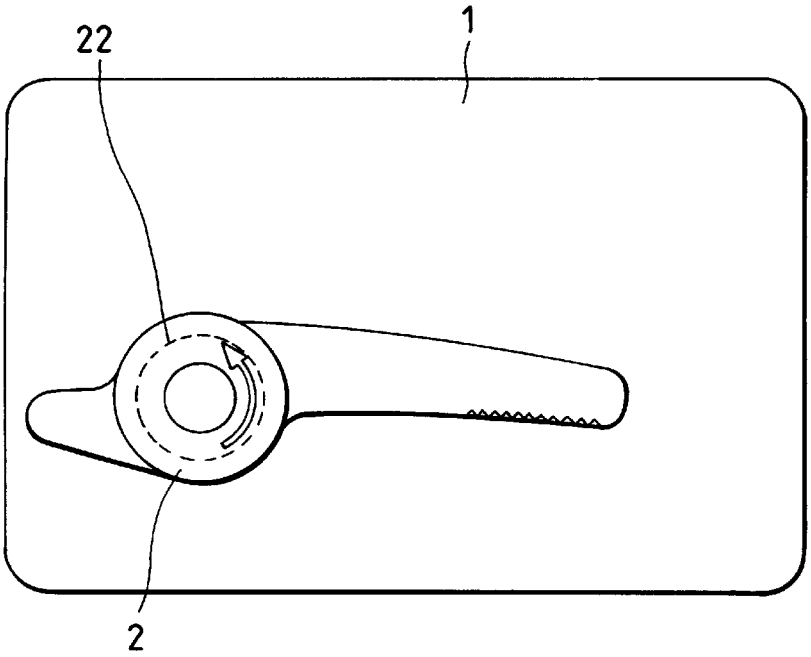
FIG. 1A is an upper surface view which shows a capped liquid container in accordance with a first embodiment of the present invention.
Figure 1B:
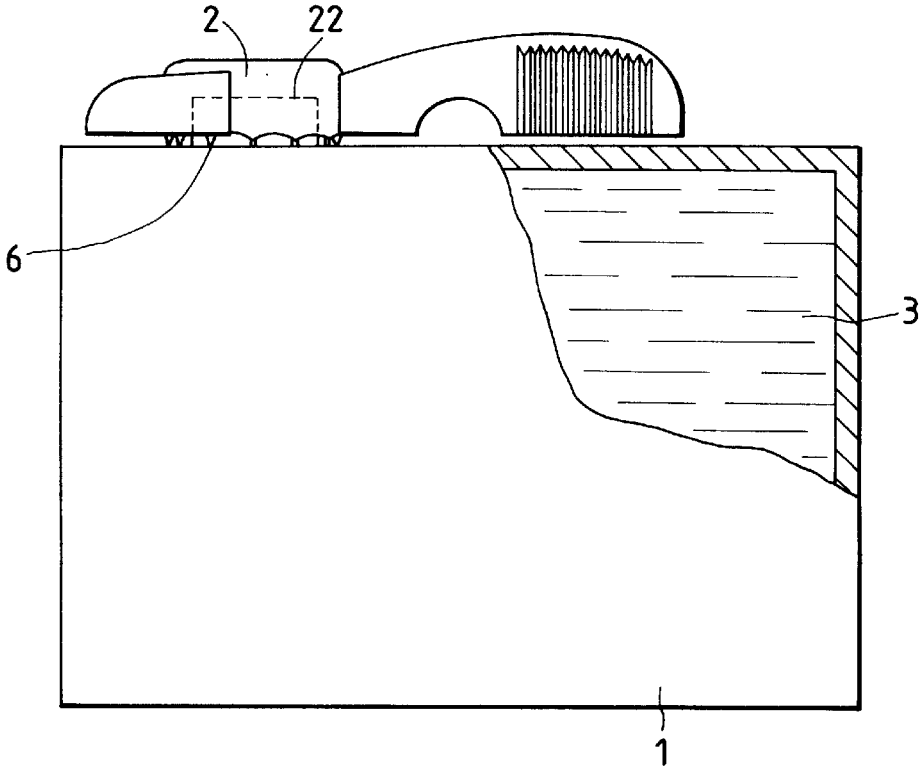
FIG. 1B is a front view which shows the capped liquid container represented in FIG. 1A.

FIG. 1A is the upper surface view which shows a capped liquid container in accordance with a first embodiment of the present invention. FIG. 1B is the front view thereof. As shown in FIGS. 1A and 1B, the capped liquid container 1 of the present embodiment retains in it liquid 3 used for recording by means of an ink jet recording apparatus. A supply opening 22 is formed on the upper surface of the liquid container 1 for supplying the liquid 3 to the recording devices of the ink jet recording apparatus. Then, a cap 2 is firmly fixed to the supply opening 22 in order to retain liquid in the liquid container 1. As a method for firmly fixing the cap 2 to the liquid container, a plurality of welding portions 6 are formed on the edge of the cylindrical portion of the cap 2 to extrude toward the liquid container 1. Then, each of the welding portions 6 is in contact with the liquid container 1. These portions 6 and the contact surface of the liquid container 1 are welded by means of ultrasonic welding.

For such capped liquid container, the sealed liquid container 1 is unsealed by rotating the cap 2 to shear the welding portions 6. The cap 2 is then removed from the liquid container 1. Therefore, unlike the conventional one, the capped liquid container of the present embodiment does not need any grooves for the engagement of the cap external member with the liquid container. Also, the cap 2 is removed from the liquid container 1 by rotating the cap 2 when the liquid container 1 is unsealed. Therefore, unlike the conventional one, there is no possibility that any external force acts upon the side faces of the liquid container so as to press them inwardly when the liquid container is unsealed. As a result, the liquid container 1 can be unsealed without allowing the liquid 3 in the liquid container 1 to spread externally. Also, the container can be open easily. In this manner, it is possible to materialize a capped liquid with a good unsealing operativity.

Figure 2C:
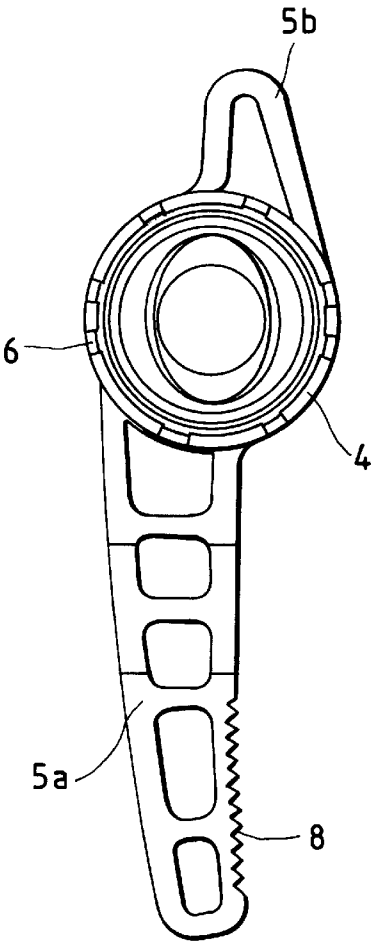
FIGS. 2A, 2B and 2C are the upper surface, side, and bottom views which illustrate the cap represented in FIGS. 1A and 1B, respectively.
Figure 2B:
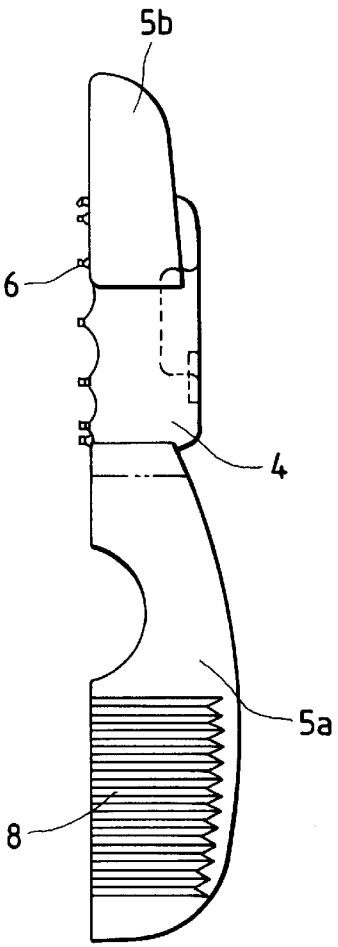
Figure 2A:
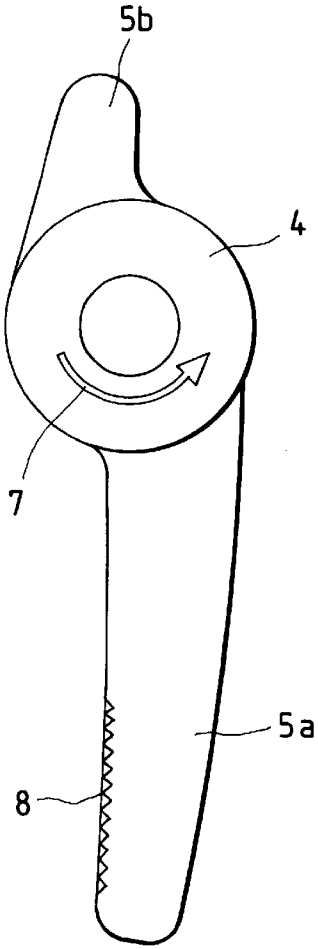

FIGS. 2A to 2C are the upper surface, side, and bottom views of the cap shown in FIGS. 1A and 1B, respectively. As shown in FIGS. 2A to 2C, the cap 2 is structured in such a manner that a curved handle 5*a* and a handle 5*b* which is smaller than the handle 5*a* are formed on a cylindrical outer member 4 that serves as a rigid body to cover the supply opening of the liquid container 1. Here, the cylindrical outer member 4 is placed between the handles. As shown in FIG. 1B, a plurality of welding portions 6 protrude on the edge of the leading end of the cylindrical outer member 4 on the liquid container 1 side in order to fix the cap 2 firmly to the liquid container 1. Each of the welding portion 6 is arranged on the circumference of the edge of the cylindrical outer member 4 at locally different pitches. On the upper surface of the cylindrical outer member 4, an arrow mark 7 is impressed to indicate the rotational direction of the cap 2. On one face of the handle 5*a*, knurling 8 is provided for the slip prevention.

Figure 3B:
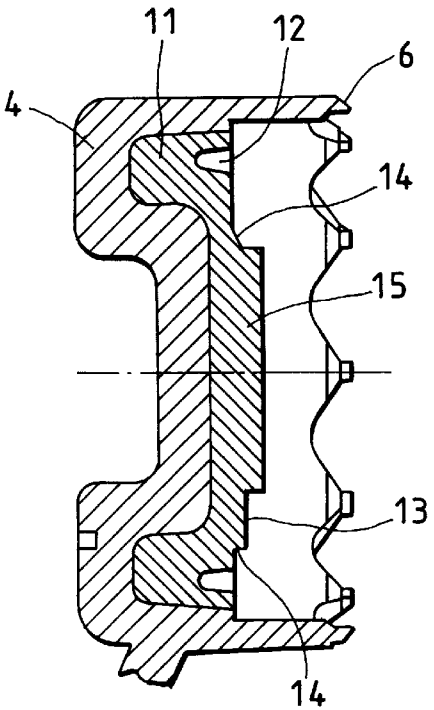
FIGS. 3A and 3B are the enlarged bottom and cross-sectional views which illustrate the portion of the cylindrical outer unit of the cap represented in FIGS. 2A, 2B and 2C respectively.
Figure 3A:
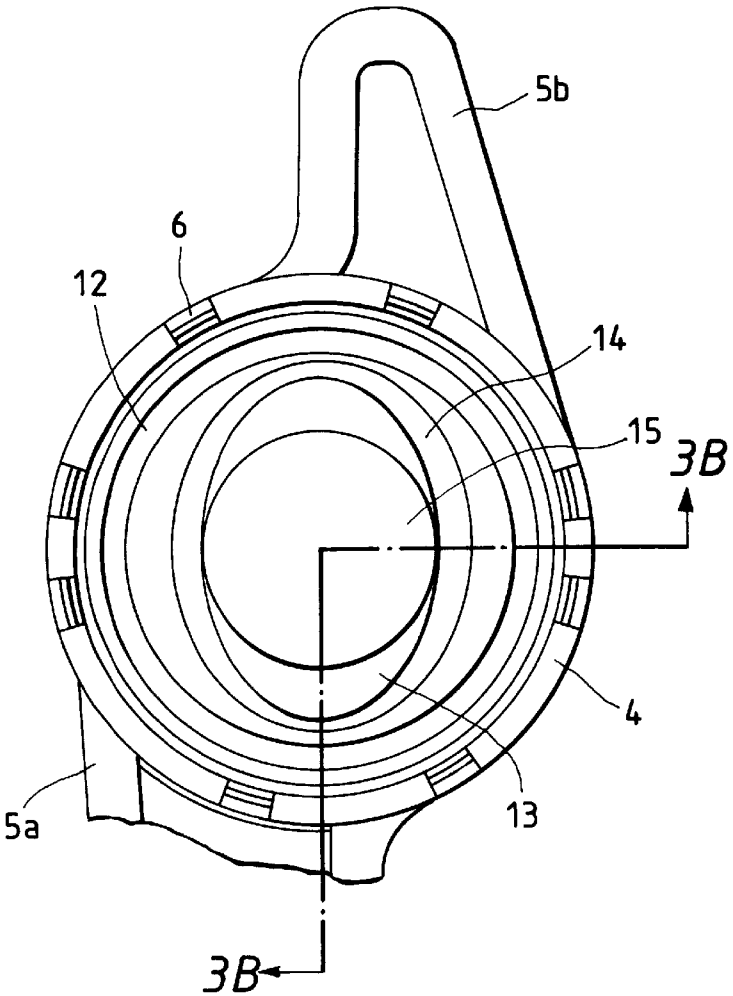

FIG. 3A is the enlarged bottom views of the portion of the cylindrical outer member 4 of the cap 2 shown in FIGS. 2A to 2C. FIG. 3B is a cross-sectional view taken along line 3B—3B in FIG. 3A. As shown in FIGS. 3A and 3B, one bottom side of the cylindrical outer member 4, namely, the reverse side thereof, is open. The central part of the other bottom side is in a form that rises inwardly to the interior of the cylindrical outer member 4. On the edge of the open face of the cylindrical outer member 4, a plurality of welding portions 6 are formed to be extruded. An elastic member 11 is formed on the bottom face of the interior of the cylindrical outer member 4, as well as its raised portion in the central part of this member. On the surface of the elastic member 11 formed in the interior of the cylindrical outer member 4, a V groove 12 is continuously formed in circle as first engagement means provided for the inner side of the outer circumference of the elastic member 11. On the inner side of the V groove 12, an overly truncated cone extrusion 13 is arranged to slightly protrude with the inclined surface 14 provided also in the form of the overly truncated cone. Further, a cylindrical inner plug 15 is arranged to protrude from the end face of the overly truncated cone extrusion 13.

Figure 4A:
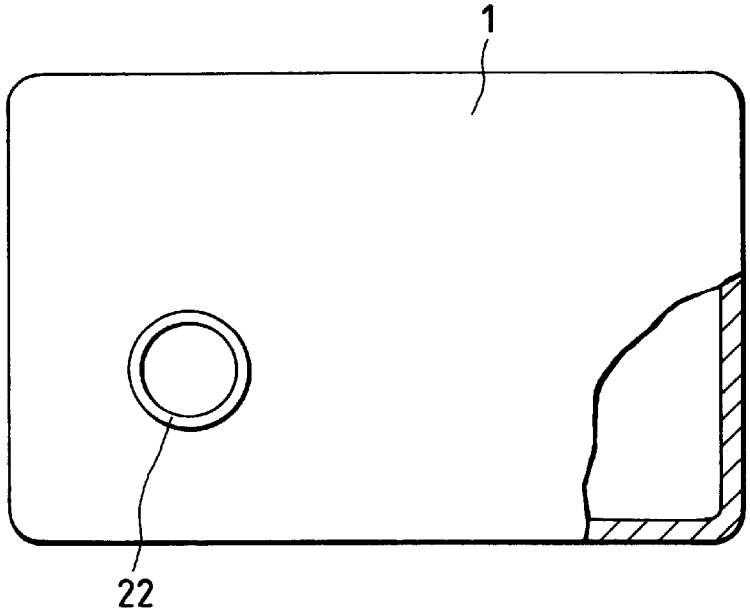
FIGS. 4A and 4B are the upper surface and cross-sectional views which illustrate the liquid container represented in FIGS. 1A and 1B.
Figure 4B:
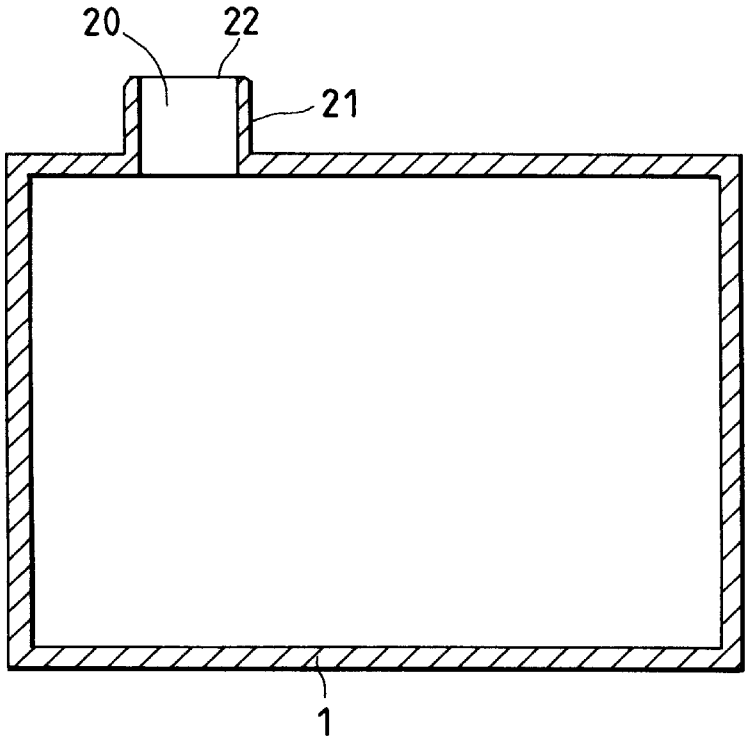

Now, with reference to FIGS. 4A and 4B and FIGS. 5A to 5C, the description will be made of the configuration of the liquid container 1. FIG. 4A is the upper view which shows the liquid container represented in FIGS. 1A and 1B. FIG. 4B is a cross-sectional view which shows the liquid container, observed from the front. As shown in FIGS. 4A and 4B, on the upper surface of the liquid container 1, a hollow cylindrical liquid supply portion 21 is arranged to protrude extensively for the supply of liquid retained in the liquid container to the recording devices of an ink jet recording apparatus. The surface of the leading end of the liquid supply portion 21 is formed to be the supply opening 22. The hollow section of the liquid supply portion 21 serves as the supply path 20. Through the supply path 20, the interior of the liquid container 1 is conductively connected with the supply opening 22. As shown in FIGS. 1A and 1B, the liquid supply portion 21 is covered by the cap 2 to close the supply opening 22, thus sealing the liquid container 1.

Figure 5A:
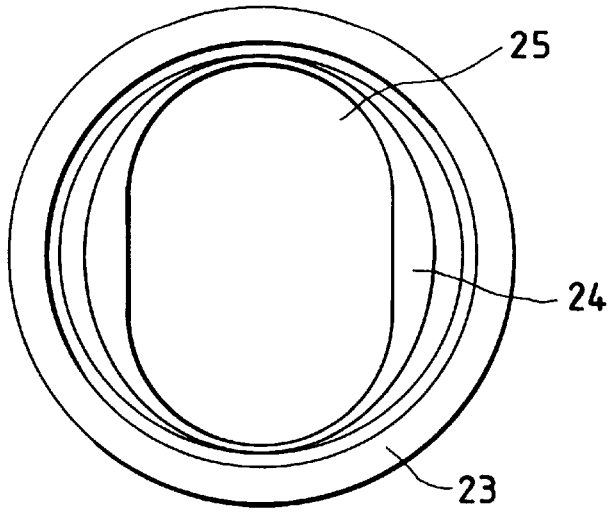
FIGS. 5A, 5B and 5C are the enlarged upper surface and cross-sectional views which illustrate a part of the liquid supply unit of the liquid container represented in FIGS. 4A and 4B, respectively.
Figure 5B:
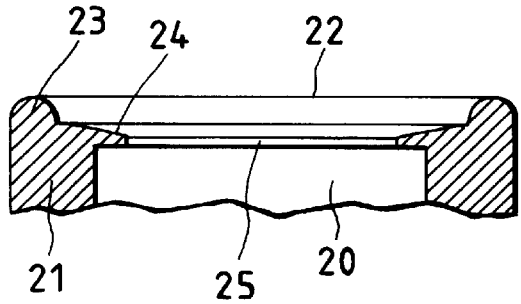

FIG. 5A is the enlarged upper view which shows the extruded leading end of the liquid supply portion 21 of the liquid container 1 represented in FIGS. 4A and 4B. FIG. 5B is a cross-sectional view which shows the portion represented in FIG. 5A, observed from the front. FIG. SC is a cross-sectional view thereof, observed from the side.

Figure 5C:
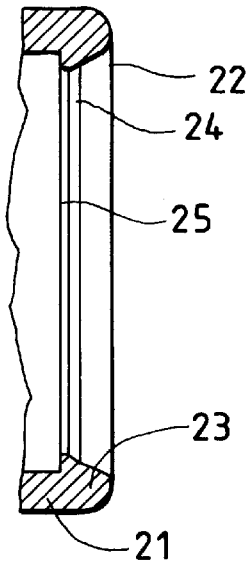

As shown in FIGS. 5A, 5B and 5C, on the edge portion of the supply opening 22 at the leading end of the liquid supply portion 21, an extrusion 23 is formed in circle, which protrudes semi-circularly as second engagement means to engage with the V groove 12 on the cap 2. Here, an elongated circular opening 25 is formed in the interior of the liquid supply portion 21 on the base of the extrusion 23. On the edge of the circumferential surface of the elongated opening 25 on the supply opening 22 side, an inclined surface 24 is formed to engage with the inclined surface 24 of the cap 2, which is provided in the form of the overly truncated cone as described earlier.

Figure 6:
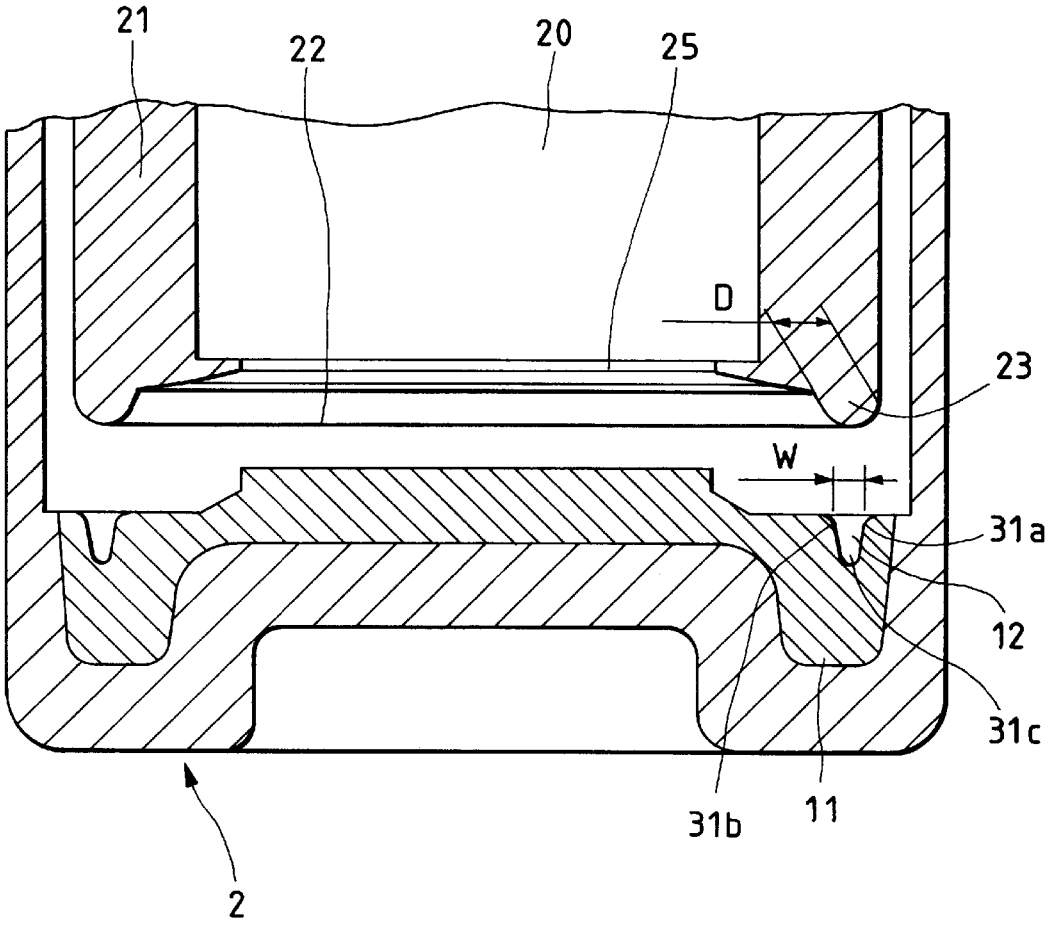
FIG. 6 is a cross-sectional view which shows the relationship of engagement between first and second means for engagement embodying the present invention.

Now, the description will be made of the relationship of engagement between the liquid supply portion 21 of the liquid container 1 and the cap 2, which are configured as described above. FIG. 6 is a cross-sectional view illustrating the relationship of engagement between them in the state before the liquid supply portion 21 and the cap 2 are in contact with each other.

As shown in FIG. 6, the diameter D of the semi-circular extrusion 23 formed on the leading end of the liquid supply portion 21 is made larger than the width W of the V groove 12. The V groove 12 and the extrusion 23 are pressed to be in contact. Also, each of the opening ends of the V groove 12 is formed as a curved surface as indicated at 31*a* and 31*b*, respectively. Each of the curved surfaces 31*a* and 31*b* serves as guide for the extrusion 23 when the extrusion 23 is pressed to abut upon the V groove 12. Further, the bottom of the V groove 12 is curved as indicated at 31*c*. Now, the description will be made of the state where the extrusion 23 and V groove 12 thus configured are pressed to be in contact.

Figure 7:
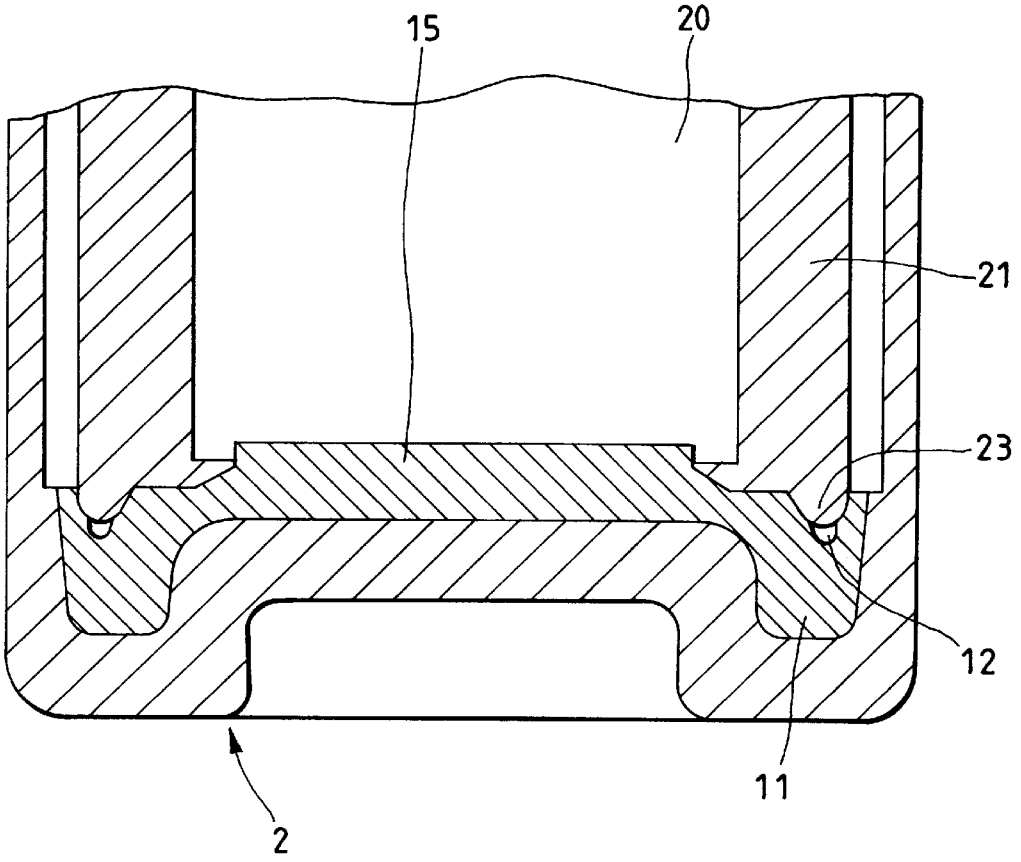
FIG. 7 is a cross-sectional view which shows the state of the cap that engages with the liquid supply unit represented in FIG. 6.

FIG. 7 is a cross-sectional view which shows the state where the extrusion 23 and the V groove 12 are pressed to be in contact with each other from the state represented in FIG. 6. As shown in FIG. 7, when the extrusion 23 and the V groove 12 are pressed to be in contact, the extrusion 23 presses the V groove 21 to make it wider, and then, the extrusion 23 is fitted into the groove 12. At this juncture, the surface of the V groove 21 which is in contact with the extrusion 23 is deformed to follow the curved surface of the extrusion 23. Therefore, the surfaces of the extrusion 23 and V groove 12 are closely in contact. This close contact between the inclined surfaces on the extrusion 23 and V groove 12 produces the sealing effect on the supply opening 22. Also, the inclined surface 14 of the cap 2 in the form of the oval truncated cone, and the inclined surface 24 of the liquid supply portion 21 produces the sealing effect on the liquid container 1 when these inclined surfaces are put together. Then, the inner plug 15 of the cap 2 is inserted into the elongated opening 25 of the liquid supply portion 21, thus protruding to the interior of the liquid supply portion 21. Here, as shown in FIG. 6, the bottom of the V groove 12 is curved as indicated at 31*c*. Therefore, the stress which is intensively exerted on the bottom of the V groove 12 is eased when the V groove 12 is made wider by pressure. In this manner, the V groove 12 is prevented from being cracked. Now, the description will be made of the relationship between the forces acting upon the contact surface of the V groove 12 and extrusion 23 represented in FIG. 7.

Figure 8:
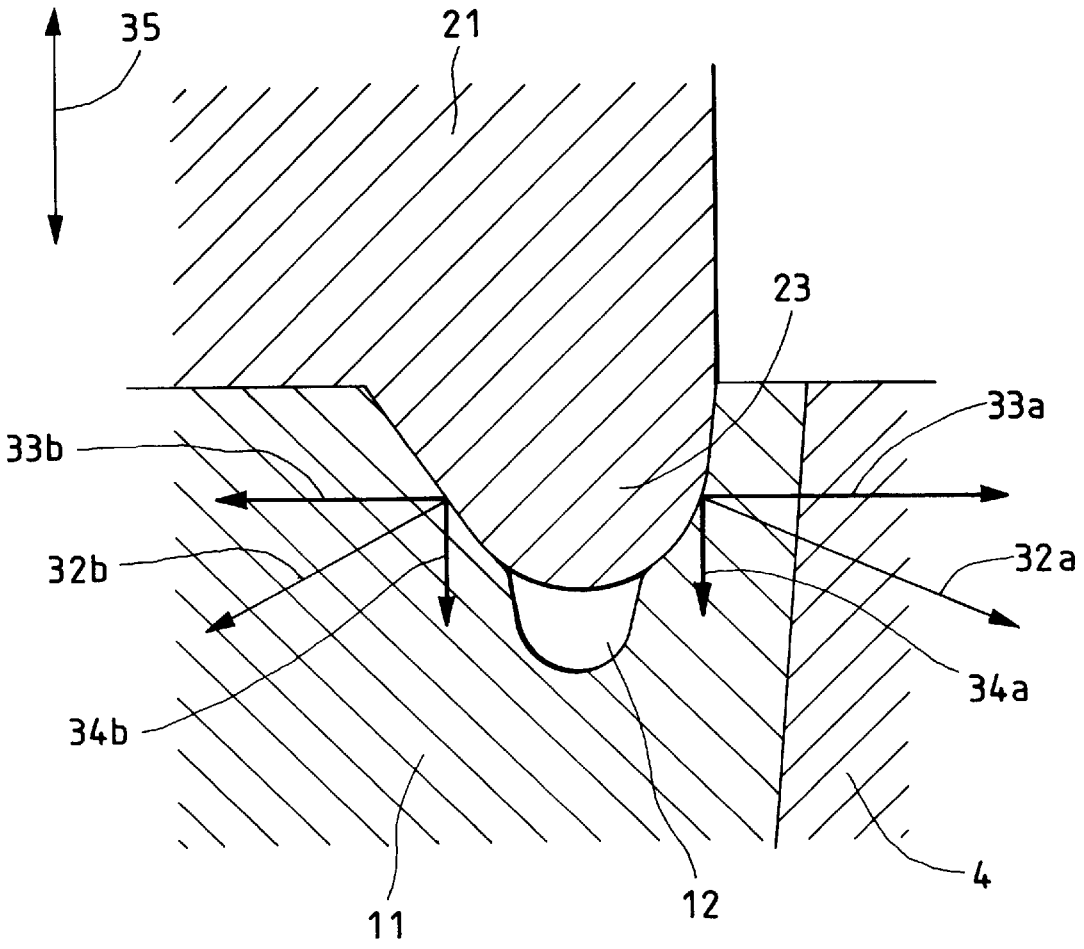
FIG. 8 is an enlarged sectional view which shows the contact surface between the V groove and the extrusion represented in FIG. 7.

FIG. 8 is an enlarged sectional view which shows a part of the contact surface of the V groove 12 and extrusion 23 represented in FIG. 7. As shown in FIG. 8, each of the compressions 32*a* and 32*b* are exerted by the extrusion 23 on the contact planes on both sides of the V groove 12 which is deformed to be wider by the pressure exerted by the extrusion 23. The compressions 32*a* and 32*b* are divided into the components 33*a* and 33*b* in the directions perpendicular to the directions 35 of the supply path, as well as divided into the components 34*a* and 34*b* in the direction parallel to the directions 35 of the supply path. Each of the components 33*a* and 33*b* is the forces whereby the extrusion 23 presses the V groove 12 to make it wider. These components are greater than the components 34*a* and 34*b*. The cylindrical outer member 4 receives the component 33*a*, while the inner plug 15 receives the component 33*b*. The components 34*a* and 34*b* act in the direction to pull and separate the welding portions 6 of the cap 2 from the liquid container 1. These components 34*a* and 34*b* act upon the welding surface of the welding portions 6.

For the conventional liquid container with the cap attached to it, forces in the same direction as that of the components 34*a* and 34*b* should be intensified in order to enhance the contactness between the supply opening and the elastic member to cover the supply opening closely. However, in accordance with the present embodiment, a higher contact pressure is obtainable by the application of the component 33*a* and 33 without making them greater. Therefore, the sealing capability is easily enhanced for closing the supply opening 22. Since the higher sealing capability can be obtained without increasing the components 34*a* and 34*b*, it becomes possible to minimize the components 34*a* and 34*b*. This arrangement facilitates the prevention of the cap 2 from being removed by any dropping shocks or other external forces that may cause the inner pressure to be increased. Also, with the structure thus adopted for the present embodiment, the components 34*a* and 34*b* become the forces that pull and separate the welding portions 6, hence making it possible to prevent the welding portions 6 from being affected by any creep deformation that may lower the close contactness between the supply opening 22 and the cap 2. Also, it becomes possible to effectively suppress the leakage of liquid or air from the interior of the liquid container 1.

Figure 9A:
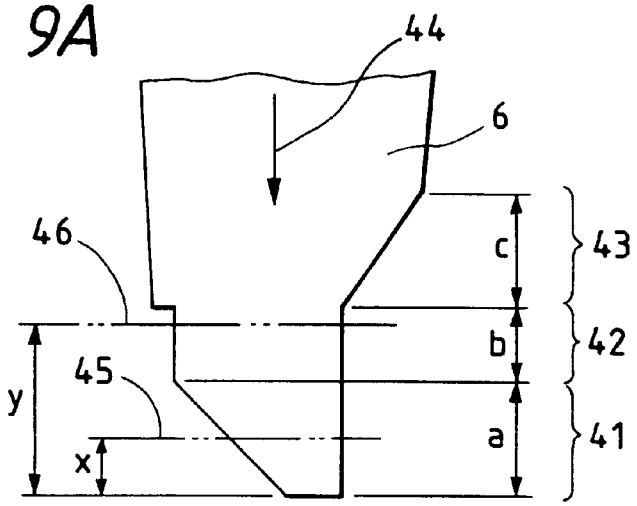
FIGS. 9A, 9B and 9C are views which illustrate the welding portion of the cap represented in FIGS. 3A and 3B.
Figure 9B:
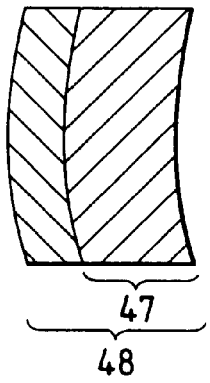
Figure 9C:
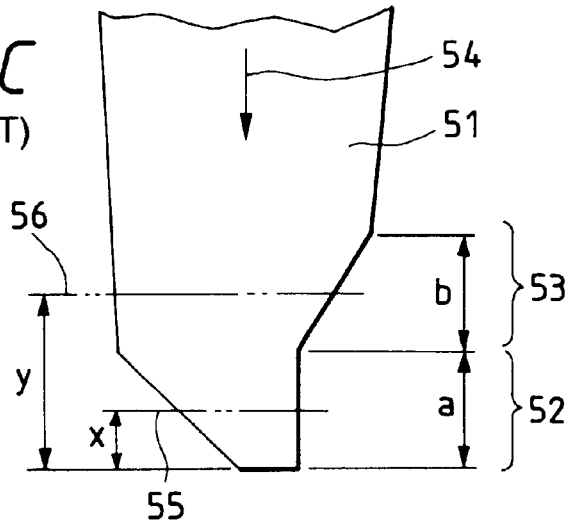
FIG. 9C (PRIOR ART)

Now, with reference to FIGS. 9A to 9C, the description will be made of the portions 6 formed on the cap 2 to be welded for fixing the cap 2 to the liquid container 1. FIG. 9A is a side view which shows such welding portion 6. FIG. 9B is a plan view which shows the welding surface of the portion 6 represented in FIG. 9A when it is welded to the liquid container 1 by the application of ultrasonic waves. FIG. 9C is a side view which illustrates the conventionally welding portion for the comparison between the welding portion 6 represented in FIG. 9A and the conventional one.

In accordance with the present embodiment, the welding portion 6 is configured as shown in FIG. 9A. This portion comprises a chamfered portion 43 with its section being perpendicular to the welding direction, which becomes gradually narrower toward the leading end from the cylindrical outer member 4 that forms the base of the welding portion 6; a straight portion 42 formed with its constant section on the leading end of the chamfered portion 43; and an acutely angled portion 41 formed on the leading end of the straight portion 42, which is configured to make its sectional area narrower toward the pit thereof. The length of each part of the welding portion 6 is designated by the reference marks a, b, and c in the welding direction 44 for the acutely angled portion 41, the straight surface 42, and the chamfered surface 43, respectively, in that order.

Each tip of the portions 6 thus configured is arranged to be in contact with one face of the liquid container 1. Then, while the portions 6 are allowed to shift in the welding direction 44, the ultrasonic welding is executed. At this juncture, the welding surface becomes the configuration shown in FIG. 9B when the portion 6 moves to the welding stroke position on the surface A at 45 which is away by a gap x from the tip of the portion 6 to be welded. Then, the welding surface is configured as indicated at 48 in FIG. 9B when the surface B moves to the welding stroke position which is away by a gap y from the tip of the portion 6 to be welded. Here, as shown in FIG. 9B, the welding area on the surface B at 46 is larger than the surface A at 45. In this manner, the portion 6 to be welded is fused from its tip. Therefore, the welding area of the acutely angled portion 41 becomes larger as the welding stroke is increased. However, the welding area of the straight surface 42 is constant even when the welding stroke is increased, because its welding area remains unchanged on that surface.

Here, with reference to FIG. 9C, the description will be made of the portions to be welded by means of the conventional ultrasonic welding. As shown in FIG. 9C, the conventionally welding portion 51 is formed by the chamfered portion 53 having the section which is perpendicular to the welding direction 54 and made gradually narrower as the section approaches the leading end from the base of the welding portion 51, as well as formed by the acutely angled portion 52 arranged on the leading end of the chamfered portion 53, which is configured to make its sectional area narrower toward the tip thereof. Therefore, as compared with the welding portion 6 of the present embodiment, the welding portion 51 is not provided with any portion equivalent to the straight portion 42 of the welding portion 6, while its acutely portion and the chamfered portion are the same as those of the welding portion 6. The length of each part of the welding portion 51 is designated by the reference marks a and b in the welding direction for the acutely angled portion 52 and the chamfered portion 53, respectively, in that order.

Figure 10:
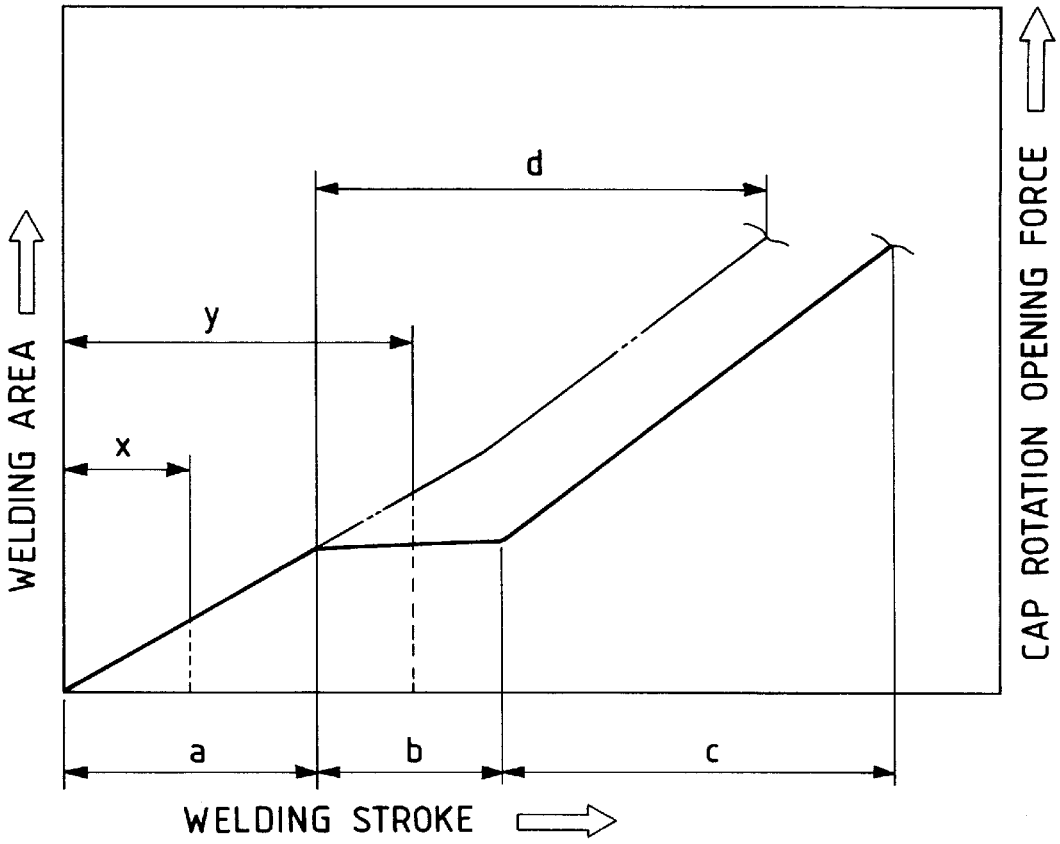
FIG. 10 is a view which shows the relationship between the welding stroke and welding area, and the welding stroke and unsealing force exerted by the rotation of the cap with respect to the welding portion represented in FIGS. 9A, 9B and 9C.

FIG. 10 is a view which shows the relationship between the welding stroke and welding area, and the welding stroke and unsealing force exerted by the rotation of the cap for both welding portions 6 and 51. In FIG. 10, the axis of abscissa indicates the shifting amount of the welding stroke, and the axis of ordinate indicates the unsealing force exerted by the rotation of the cap. The solid line indicates the relationship with respect to the welding portion 6. The two-dot chain line indicates the relationship with respect to the welding portion 51.

As shown in FIG. 10, the welding area and the unsealing force exerted by the rotation of the cap increase in proportion to the increase of the welding strokes within the range of the acutely angled portions 41 and 52 of the welding portions 6 and 51. However, in the range of the straight portion 42 of the welding portion 6, the welding area and the unsealing force exerted by the rotation of the cap are substantially the same even when the welding stroke increases. Within the ranges of the chamfered portion 43 of the welding portion 6 and the chamfered portion 53 of the welding portion 51, the welding area and the unsealing force exerted by the rotation of the cap increase in proportion to the increase of the welding strokes. Also, from the results of experiments, almost the primary correlation is observed between the welding area and the unsealing force exerted by the rotation of the cap.

In accordance with the present embodiment, the material used for the cap 2 and the welding portions 6 is different from the one used for the liquid container 1. Here, the material used has a deformation temperature which is higher by 30° C. and different grade as well. As a result, the destructive mode in which the welding portions 6 are sheared for unsealing the liquid container becomes closer to the surface separation rather than to the cohesive failure. More specifically, the indicated destructive mode is such that the partly sheared resin mold of the cap 2 remains on the surface of the liquid container 1 when the cap 2 is unsealed. Conceivably, the influence of such destructive mode may have brought about the primary correlation between the welding area and the welding strength, namely, the unsealing force exerted by the rotation of the cap. It is generally conceivable that the destructive strength sustained by the ultrasonic welding is proportional to the welding volume of a target member. However, for the present embodiment, the correlation between the characteristic values is such that the welding area is increased in proportion to the increase of the welding stroke of the welding portion 6, and that the unsealing force exerted by the rotation of the cap is increased in proportion to the increase of the welding area. Further, with respect to the other relationship, the contact area between the extrusion 23 and the V groove 12 described earlier is increased in proportion to the increase of the welding stroke given to the welding portion 6, and in proportion to increase of the contact area, the sealing capability of the supply opening is increased.

Therefore, with the welding stroke being made larger to secure the sealing capability for the conventionally welding portions 51 shown in FIG. 9C, the welding area is increased so that the unsealing force which should be exerted by the rotation of the cap may become much greater. However, since each of the welding portions 6 adopted for the present embodiment is provided with the straight surface whose sectional area is uniform in the direction perpendicular to the welding direction, there is a region where the welding area is not increased eventually even if the welding stroke is increased as shown in FIG. 10. As a result, with the arrangement that enables the cap to be fixed to the liquid container in this region, it becomes possible to secure the reliable sealing capability, such as air tightness, water tightness, and the reliable strength of welding for the cap that may withstand the dropping shock or the like, and also, to secure the reliability and operativity with which the cap can be unsealed with an appropriate force exerted by the rotation of the cap. Therefore, the cap 2 can be fixed easily to the liquid container 1 without considering any trade-off in the management and control when applying the welding stroke in the manufacture of containers.

Then, when a plurality of capped liquid containers of the present embodiment are used, each of them can be unsealed stably by means of a specific rotation. Moreover, since the cylindrical outer member 4 of the cap 2 covers the liquid supply portion 21 of the liquid container 1, there is no possibility that liquid is caused to spread when the cap 2 is unsealed. With the arrangement thus made to provide a good operativity, the operator can open it without staining his hand or some other part.

In this respect, capped liquid containers, which are produced in accordance with the present embodiment, are left intact for 24 hours for the tests under the environment whose atmosphere is reduced by 0.7, with liquid being retained in the liquid container. There is no leak (leakage) of the liquid and air contained in the liquid container due to the inner pressure thereof. Here, on the contrary, the cap receives pressure under the compressive environment so that the component 33*a* and components 33*a* and 33*b* are made larger, thus increasing the contact area between the V groove 12 and the extrusion 23. As a result, the sealing effect of the supply opening 22 is enhanced.

Also, in order to increase the inner pressure of a liquid container, a polypropylene cap is fixed to a capped liquid container, and the container is left intact for two months under the environment of 60° C. There is observed no leakage of liquid and air to the outside from the interior of the liquid container 1. Further, capped liquid containers, each weighing 70 to 120 gf, are dropped freely onto a concrete floor from a height of 120 cm. No cap 2 is caused to fall off from each of the liquid containers 1. Also, there is no leakage of liquid and air to the outside from the interior thereof.

Also, for the cap 2 of the present embodiment, the welding portions 6 are arranged at locally different pitches on the circumference of the edge of the cylindrical outer member 4. Now, in conjunction with FIG. 11 and FIGS. 12A and 12B, the reasons for such arrangement will be described.

Figure 11:
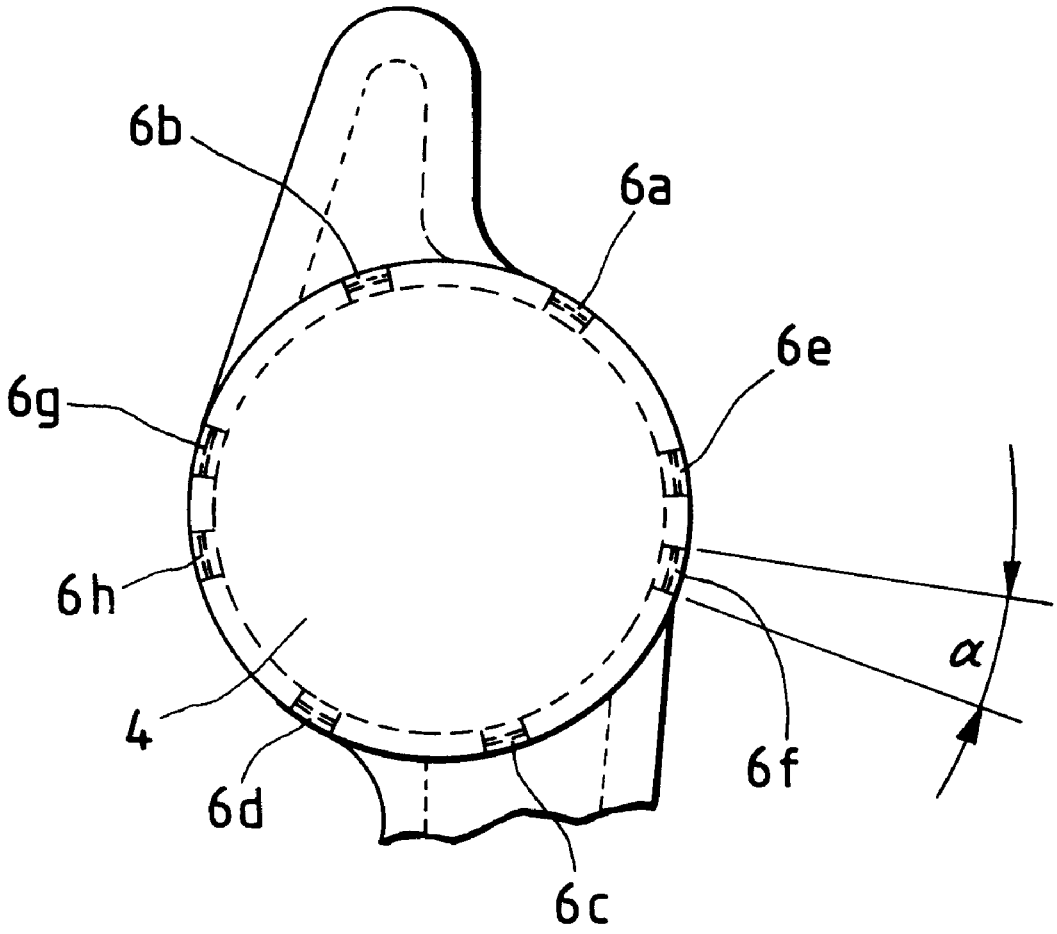
FIG. 11 is a view which shows the arrangement of the welding portions of the cap represented in FIGS. 3A and 3B.

FIG. 11 is an upper view of the cap 2, which shows the arrangement of plural portions to be welded. As shown in FIG. 11, eight welding portions 6*a*, 6*b*, 6*c*, 6*d*, 6*e*, 6*f*, 6*g*, and 6*h* are arranged for the cap 2. Each of the welding portions is formed in a width at an arbitrary angle a to the center of the cylindrical outer member 4. Particularly, the gap between the welding portions 6*e* and 6*f*, and the gap between the welding portions 6*g* and 6*h* are made narrower than those between other welding portions.

Figure 12B:
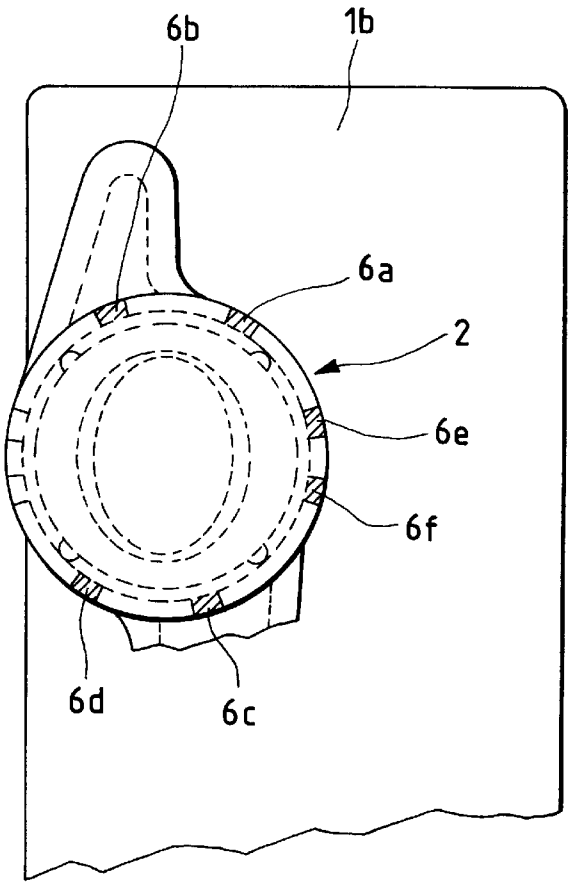
FIGS. 12A and 12B are the upper surface views which illustrate the states where the cap represented in FIG. 11 is welded on the liquid container having a narrower bottom, and on the liquid container having a wider bottom, respectively.
Figure 12A:
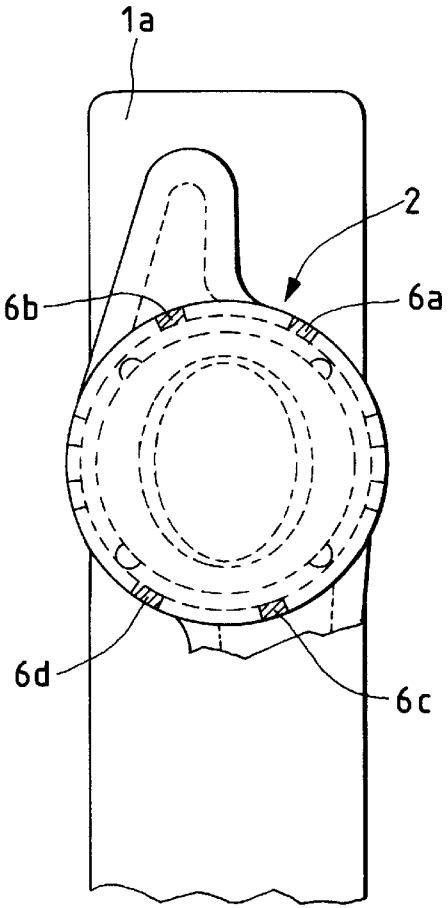

FIG. 12A shows the case where the cap 2 is welded to a liquid container whose bottom surface is narrower. FIG. 12B shows the case where the cap is welded to a liquid container whose bottom surface is wider.

For the liquid container 1*a* whose bottom surface is narrower, the diameter of the cylindrical outer member 4 of the cap 2 is larger than the width of the liquid container la as shown in FIG. 12A. Therefore, the cap 2 is welded to the liquid container la on the portions 6*a*, 6*b*, 6*c*, and 6*d*, but not on the portions 6*e*, 6*f*, 6*g*, and 6*h*. In contrast, for the liquid container 1*b* having a wider bottom surface than that of the liquid container 1*a*, the cap 2 is welded to the liquid container 1*b* on the six portions, from 6*a* to 6*f*, as shown in FIG. 9B. For each of the welding portions, the angle a is not necessarily the same. If, for example, the angle a of the welding portions 6*a*, 6*b*, 6*c*, and 6*d* is 80, while the width of the welding portions 6*e*, 6*f*, 6*g*, and 6*h* is 12°, the angle for the liquid container la is 32°=8°×4. The angle for the liquid container 1*b* is 56°=32°+(12°×2 locations). Also, if the angle $\alpha$ is equally 8° for all of them, it is 48°=8°×6 for the liquid container 1*b*. Usually, the gross weight of the liquid container having the wider bottom face is heavier when it contains liquid. The cap welded to such liquid container should withstand a stronger dropping shock. However, it is possible to weld the same cap to each of the liquid containers having different volume by the application of different welding strength if only the pitch arrangement of the welding portions and the angle that presents the width between the welding portions are adjusted for combination as described above. Therefore, with the adjusted arrangement of pitches between welding portions and widths between them, the caps can be used for the liquid containers having different volumes. This is an advantage when manufacturing them. At the same time, this makes it possible to provide the same operativity even for the capped liquid containers each having different volume.

(Second Embodiment)

Figure 13:
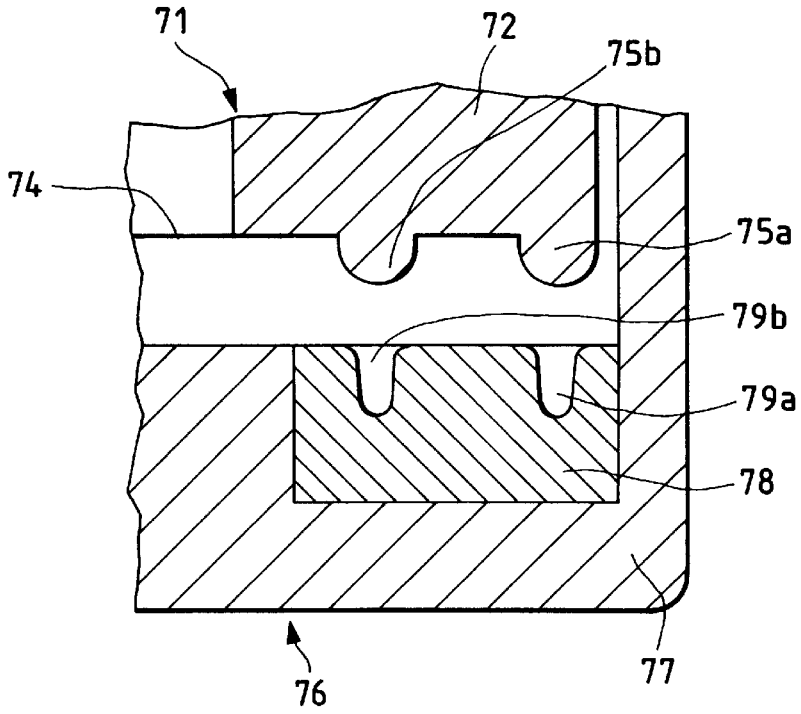
FIG. 13 is a cross-sectional view which shows a capped liquid container most appropriately in accordance with a second embodiment of the present invention.

FIG. 13 is a cross-sectional view which shows a capped liquid container most appropriately in accordance with a second embodiment of the present invention. For the present embodiment, only the first engagement means provided for the cap and the second engagement means provided for the liquid container are different from those arranged for the first embodiment. FIG. 13 is an enlarged view showing the state of the first and second engagement means before being coupled together. Hereinafter, therefore, the description will be made of the second embodiment centering on these means. For any other structures and configurations, however, the description will be omitted.

As shown in FIG. 13, the capped liquid container of the present embodiment is provided with a V groove 79*a* which is formed in circle on the surface of an elastic member 78 arranged on the reverse side of the cap as in the V groove 12 and the extrusion 23 described for the first embodiment. An extrusion 75*a* that engages with the V groove 79*a* is formed on the edge circumference of the supply opening 74 arranged on the leading end of the liquid supply portion 72 of the liquid container 71. Further, on the inner circumference of the V groove 79*a* and the extrusion 75*a*, a V groove 79*b* and an extrusion 75*b* are formed, respectively. As a result, in accordance with the present embodiment, the V grooves 79*a* and 79*b* serve as the first engagement means, while the extrusions 75*a* and 75*b* serve as the second engagement means. In other words, the structure is arranged so that another pair of the first and second engagement means adopted for the first embodiment are provided for the present embodiment.

Figure 14:
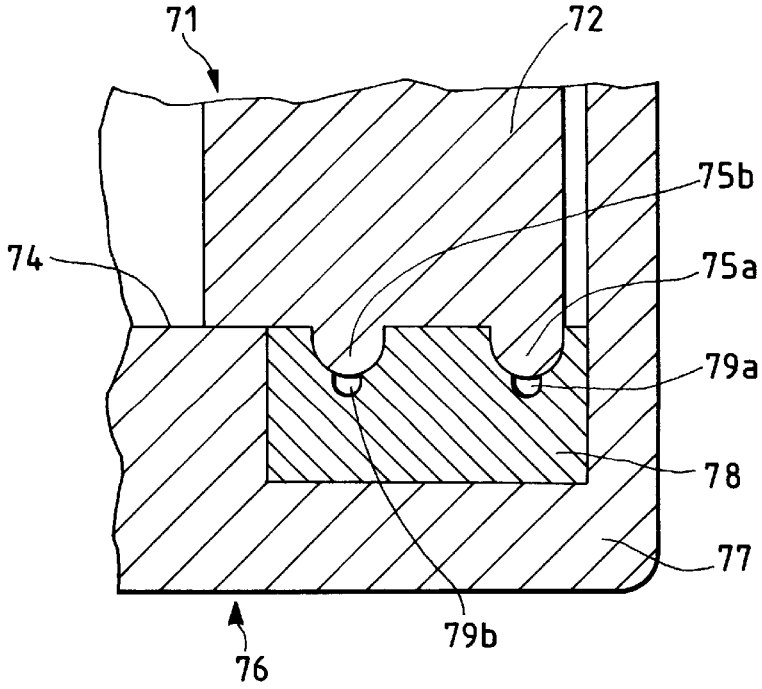
FIG. 14 is a cross-sectional view which shows the state of engagement between the V grooves and extrusion represented in FIG. 13.

FIG. 14 is a cross-sectional view which shows the state of the first and second engagement means adopted for the present embodiment after being coupled together. As shown in FIG. 14, each of the extrusions 75*a* and 75*b* is pressed to be inserted into each of the V grooves 79*a* and 79*b*. In this manner, the contact area between them is increased more than that of the first embodiment, hence the sealing capability of the supply opening being enhanced.

As described above, a plurality of V grooves and extrusions are formed to improve the sealing capability, hence making it possible to materialize a capped liquid container having a higher water tightness and air tightness.

(Third Embodiment)

Figure 15:
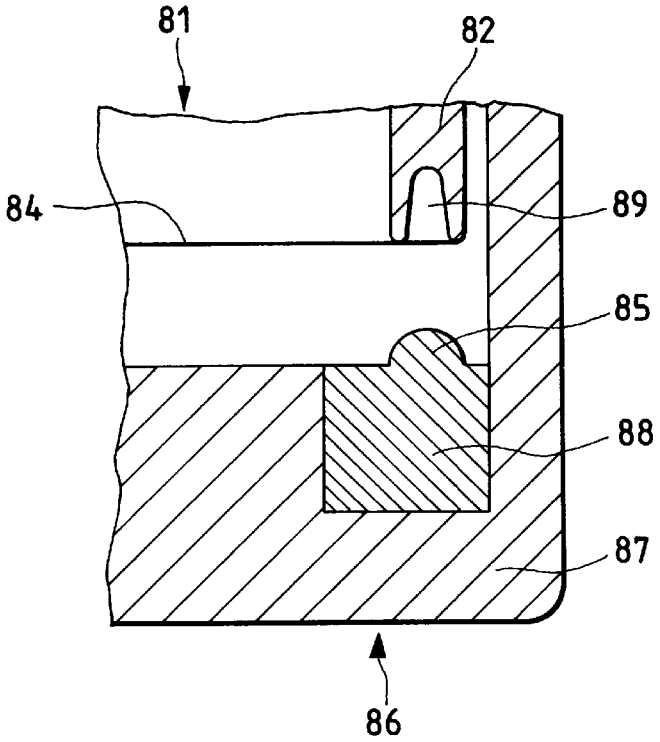
FIG. 15 is a cross-sectional view which shows a capped liquid container most appropriately in accordance with a third embodiment of the present invention.

FIG. 15 is a cross-sectional view which shows a capped liquid container most appropriately in accordance with a third embodiment of the present invention. For the present embodiment, only the first engagement means provided for the cap and the second engagement means provided for the liquid container are different from those arranged for the first embodiment. FIG. 15 is a n enlarged view showing the state of the first and second engagement means before being coupled together. Hereinafter, therefore, the description will be made of the third embodiment centering on these means. For any other structures and configurations, however, the description will be omitted.

Figure 16:
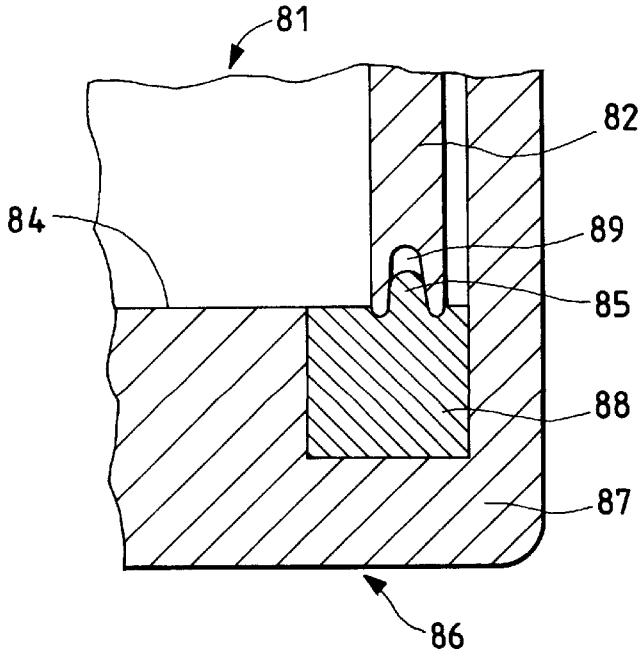
FIG. 16 is a cross-sectional view which shows the state of engagement between the V groove and extrusion representing in FIG. 15.

As shown in FIG. 15, the capped liquid container of the present embodiment is provided with an extrusion 85 is formed on the elastic member 88 arranged on the reverse side of the cap 86 as the first engagement means. A V groove 89 which is arranged to engage with the extrusion 85 is formed on the edge circumference of the supply opening 84 at the leading end of the liquid supply portion 82 of the liquid container 81. As compared with the first embodiment, the arrangement relationship between them is inverted for the present FIG. 16 is a cross-sectional view which shows the state of the V groove 89 and the extrusion 85 represented in FIG. 15 after being in contact with each other. As shown in FIG. 16, the extrusions 85 is pressed to be inserted into the V grooves 89. In this manner, the contact area between them provides the sealing effect for the supply opening 84 as in the first embodiment.

As described above, even when the positional relationship between the V groove and extrusion is inverted, it is possible to materialize a capped liquid container having a high water tightness and air tightness by the application of the sealing effect thus produced by means of the contact surface between the V groove and extrusion.

(Fourth Embodiment)

Figure 17:
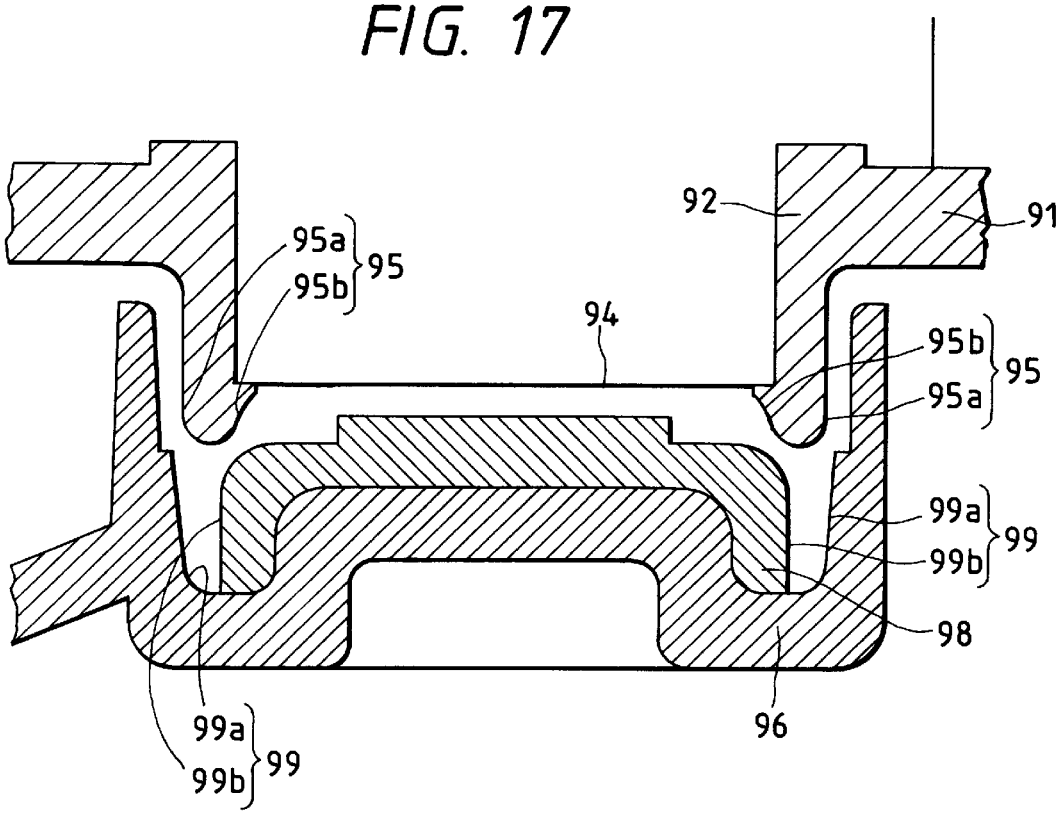
FIG. 17 is a cross-sectional view which shows a capped liquid container most appropriately in accordance with a fourth embodiment of the present invention.

FIG. 17 is a cross-sectional view which shows a capped liquid container most appropriately in accordance with a fourth embodiment of the present invention. For the present embodiment, means for pressing and coupling the first engagement means provided for the cap and the second engagement means provided for the liquid container together is different from those arranged for the first embodiment to the third embodiment. FIG. 17 is an enlarged view showing the state of the first and second engagement means before being coupled together. Hereinafter, therefore, the description will be made of the fourth embodiment centering on the means for pressing and coupling them together. For any other structures and configurations, however, the description will be omitted.

As shown in FIG. 17, the capped liquid container of the present embodiment is provided with a V groove 99 which is formed on the surface of an elastic member 98 arranged on the reverse side of the cap as the first engagement means, and the extrusion 95 that engages with the V groove 99 is formed on the edge circumference of the supply opening 94 arranged on the leading end of the liquid supply portion 92 of the liquid container 91 as the second engagement means. For the present embodiment, the V groove 99 is structured by an elastic element and a rigid element.

Figure 18:
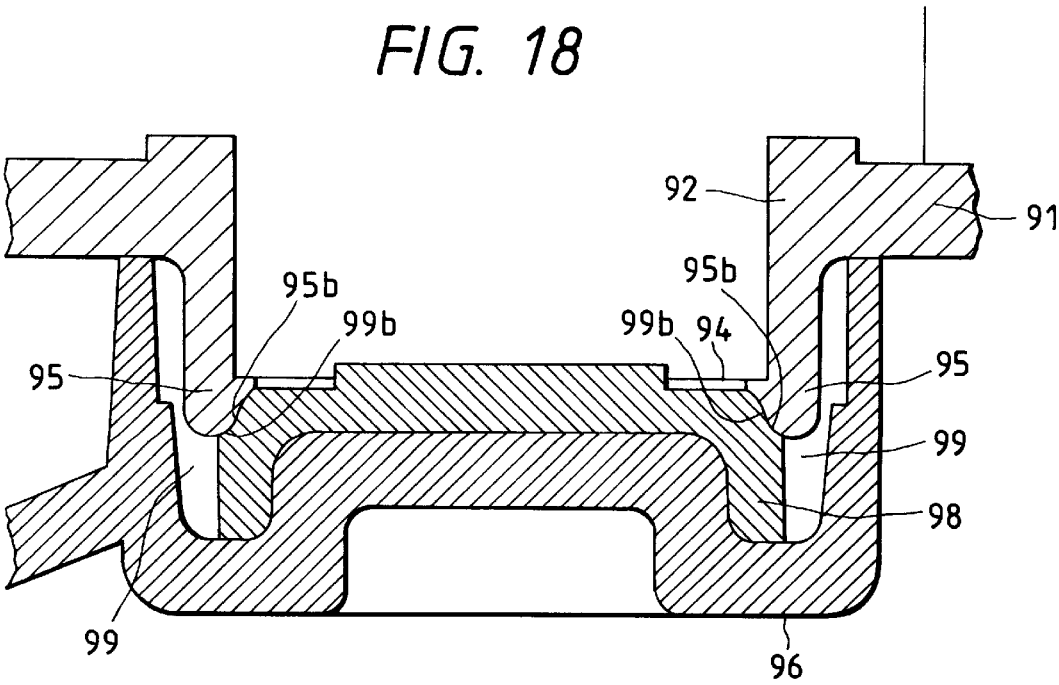
FIG. 18 is a cross-sectional view which shows the state of engagement between the V grooves and extrusions represented in FIG. 17.
Figure 19:
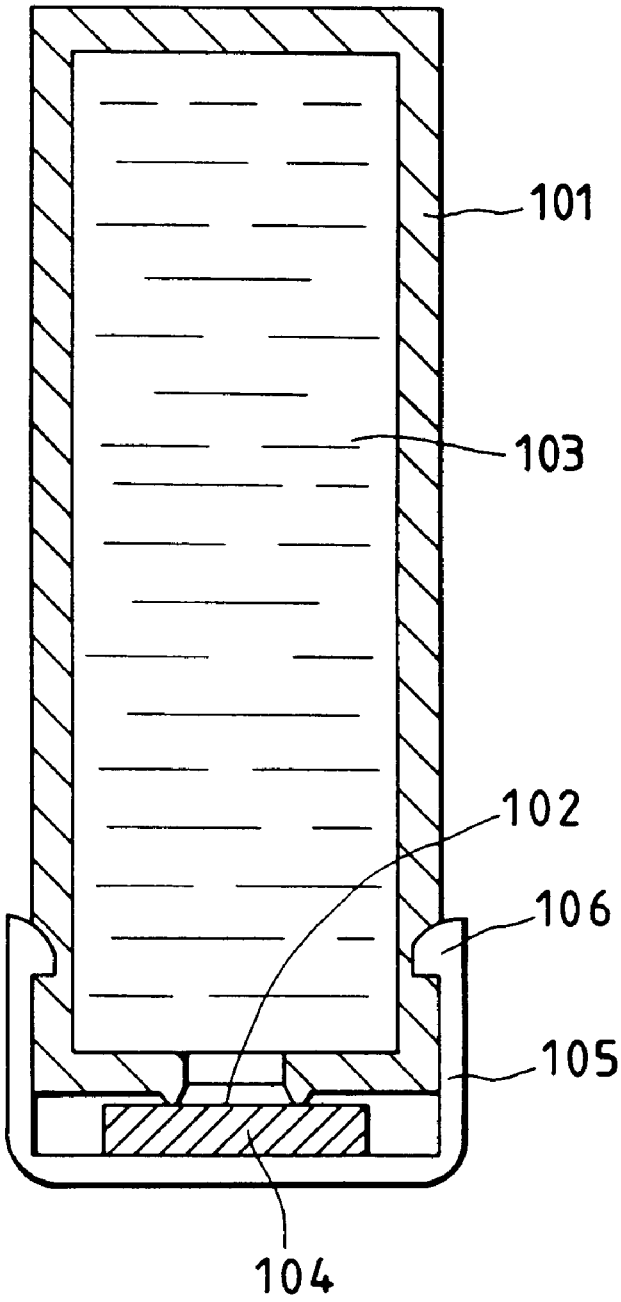
FIG. 19 (PRIOR ART)
FIG. 19 is a cross-sectional view which shows a capped liquid container in accordance with the conventional art.
Figure 20A:
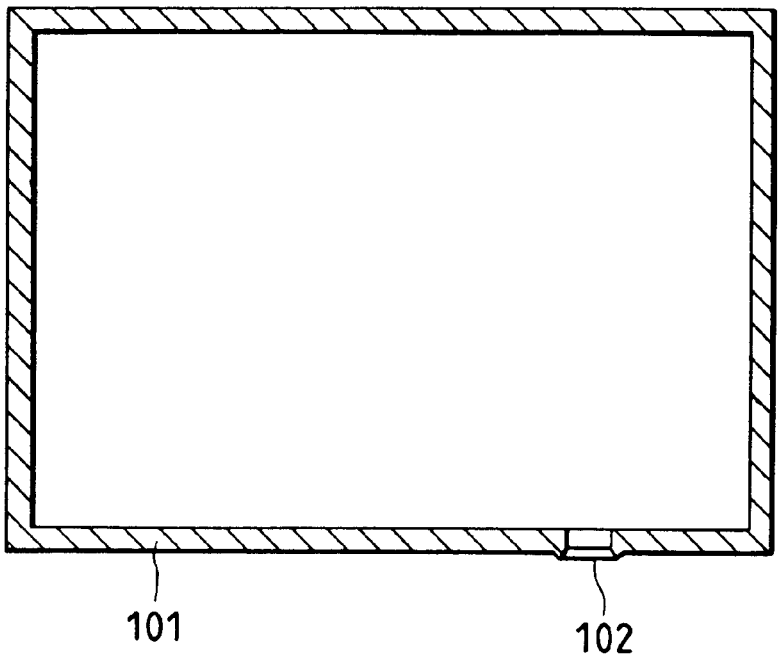
FIG. 20A (PRIOR ART)
FIG. 20A is a cross-sectional view which shows the liquid container represented in FIG. 19.
Figure 20B:
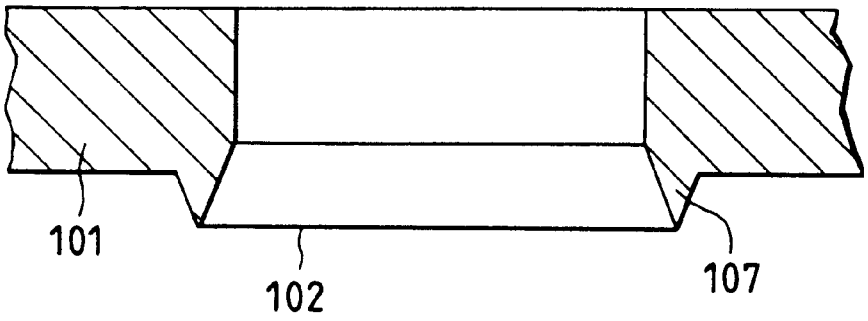
FIG. 20B (PRIOR ART)
FIG. 20B is an enlarged sectional view which shows the portion of the supply opening of the liquid container represented in FIG. 20A.

FIG. 18 is a cross-sectional view which shows the state of the first and second engagement means adopted for the present embodiment after being coupled together. As shown in FIG. 18, the extrusion 95 is pressed to be inserted into the V groove 99. At this juncture, among the side walls 95*a*, 95*b*, 99*a*, and 99*b* (the subscript a indicates the outer circumference of the circle, and b indicates the inner circumference thereof) that form the V groove and the extrusion, respectively, of the present embodiment, the side walls 95*b* and 99*b* on the inner circumference side are pressed to be in contact with each other. In this manner, the contact area between them produces the sealing effect on the supply opening 94 as in each of the embodiments described above.

Here, in accordance with the present embodiment, the inner wall faces of the side walls that form the V groove and the extrusion, respectively, are pressed to be in contact. However, it may be possible to arrange the structure so that the outer wall faces are pressed to be joined. In this manner, if at least one set of the side walls themselves are pressed to be coupled together, irrespective of the inner or outer circumferential side of the groove and extrusion, it is possible to materialize a capped liquid container having a high water tightness and air tightness by the application of the sealing effect produced by the contact surface between the V groove and the extrusion.

In this respect, the present invention is not necessarily limited to the formation of the groove or the extrusion itself by the elastic element entirely. It should be good enough if only the groove provided for the elastic member as a first engagement or the extrusion provided for the elastic member as a second engagement member is configured so that its elastic member should directly participate in the engagement. It is to be understood that such embodiment is also included in the scope of the invention hereof.

For the first to fourth embodiments described above, the first engagement means provided for the cap is an elastic member. Here, in place of the first engagement means, the second engagement means may be an elastic member. Also, it may be possible to make both of them elastic members.

Also, the cap used for the first to fourth embodiments, its elastic member may be formed by elastomer (rubberon manufactured by Mitsubishi Chemical Kabushiki Kaisha, for example), while the rigid members, such as the cylindrical outer member, handles, are formed by thermoplastic resin. Then, the elastic members and rigid members are produced by injection molding in the bicolor formation mode. However, it may be possible to form the elastic members by compression, and the elastic member thus formed may be used as a rigid member which may be incorporated with an outer member.

Further, in accordance with the first to third embodiments, the opening portion of the liquid container is configured to an elongated circle. However, the present invention is not necessarily limited to this configuration. It may be oval. With the opening portion being formed to be an elongated circle or oval, it becomes possible to make the area of the opening portion wider within the limited width of the bottom face of the liquid container. The configuration of the supply opening may be an elongated circle or oval as in the opening portion.

Further, in accordance with the first to fourth embodiments, the first and second engagement means are not necessarily limited to the V groove or the extrusion whose section is semi-circular. For example, the first engagement means is a circular V groove, while the second engagement means is a circular extrusion whose section is trapezoidal. When this V groove and the trapezoidal extrusion are arranged to face each other, and pressed, the extrusion is inserted into the V groove. Here, the arrangement should be made so that the V groove and extrusion are formed in a size to allow the inclined surfaces thereof are to be in contact under pressure. In other words, the first and second engagement means can be arranged with its section being in any shapes if only the first and second engagement means can maintain a relationship that allows them to be in contact with each other.

As described above, a capped liquid container of the present invention comprises a liquid container having a supply opening formed for it; and a cap fixed to the liquid container for closing the supply opening airtightly. The cap is removed from the liquid container when it is rotated to unseal the capped liquid container. The cap is formed by a rigid member and an elastic member. First engagement means is provided for the elastic member, and second engagement means is provided for the edge circumferential portion of the supply opening to engage with the first engagement means. The first and second engagement means are pressed to be in contact with each other. At the same time, a part of the rigid member of the cap is fixed to the liquid container. In this manner, the contact surface between the first and second engagement means produces the sealing effect, hence making it possible to materialize a capped liquid container having a high water tightness and air tightness. Furthermore, when the liquid container is unsealed, it is easy to open the liquid container without causing liquid to spread externally. There is an effect that the operativity is significantly enhanced.

What is claimed is:

1. A capped liquid container comprising:

a liquid container retaining liquid, having a supply opening formed for supplying said liquid to recording devices of an ink jet recording apparatus; and a cap fixed to said liquid container for closing said supply opening, said cap being removable from said liquid container by rotating said cap, said cap being formed by a rigid member and an elastic member, and said elastic member is provided with first engagement means, wherein second engagement means is formed on an edge circumference of said supply opening to engage with said first engagement means, wherein a part of the rigid member of said cap is fixed to said liquid container such that said first engagement means and said second engagement means are sealingly pressed together, wherein said rigid member of said cap is provided with a cylindrical outer member to cover said supply opening, and a plurality of welding portions are formed to extrude from an edge portion of said cylindrical outer member and welded to said liquid container, and wherein each of said plurality of welding portions is provided with a straight portion having a uniformly configured section in a direction perpendicular to a welding direction.

2. A capped liquid container according to claim 1, wherein said first engagement means is one or plural grooves formed in a circle, and said second engagement means is one or plural extrusions formed in a circle.

3. A capped liquid container according to claim 1, wherein said first engagement means is one or plural extrusions formed in a circle, and said second engagement means is one or plural grooves formed in a circle.

4. A capped liquid container according to claim 2, wherein said groove or grooves is a V groove, and the sectional configuration of said extrusion or extrusions is semi-circular, the diameter of said semi-circular extrusions being larger than the width of said V grooves.

5. A capped liquid container according to claim 2, wherein said groove or grooves and said extrusion or extrusions are provided with inner and outer side walls, respectively, and at least one of inner circumferential side walls and outer circumferential side walls said grooves and said extrusions is sealingly pressed together.

6. A capped liquid container according to claim 1, wherein from among said plurality of welding portions, the numbers of portions to be welded to said liquid container are different in accordance with the size of said liquid container.

7. A capped liquid container according to claim 1, wherein said cap is removed from said liquid container by shearing of said welding portions by rotation of said cap.

8. A capped liquid container according to claim 1, wherein said cap has a handle on a part of said rigid member.

9. A capped liquid container according to claim 1, wherein said plurality of welding portions are arranged on an edge portion of said cylindrical outer member at locally different pitches.

10. A capped liquid container according to claim 9, wherein a plurality of said welding portions are formed with its sectional configurations being different in the direction perpendicular to the welding direction.

11. A capped liquid container according to claim 1, wherein an opening portion is formed on a supply path conductively connected from the interior of said liquid container to said supply opening, and an extrusion fitted into said opening portion is formed on said first engagement means of said cap, said opening portion and said extrusion being fitted to each other when said first and second engagement means are sealingly pressed together.

12. A capped liquid container according to claim 11, wherein the shape of said opening portion is circular, elliptical, or oval.

13. A capped liquid container according to claim 11, wherein the shape of said extrusion formed on said cap is truncated conical, truncated oval, or truncated elliptically conical, and an inclined surface is formed on the edge circumference of said opening portion to fit onto the inclined surf ace of said extrusion.

14. A capped liquid container comprising:

a liquid container retaining liquid, having a supply opening formed for supplying said liquid to recording devices of an ink jet recording apparatus; and a cap fixed to said liquid container for closing said supply opening, said cap being removable from said liquid container by rotating said cap such that the liquid is supplied to the outside of said liquid container, said cap being formed by a rigid member and an elastic member, and said elastic member is provided with first engagement means, wherein second engagement means is formed on an edge circumference of said supply opening to engage with said first engagement means, wherein a part of the rigid member of said cap is fixed to said liquid container such that said first engagement means and said second engagement means are sealingly pressed together, wherein said rigid member of said cap is provided with a cylindrical outer member to cover said supply opening, and a plurality of welding portions are formed to extrude from an edge portion of said cylindrical outer member and welded to said liquid container; and wherein from among said plurality of welding portions, the numbers of portions to be welded to said liquid container are different in accordance with the size of said liquid container.

15. A capped liquid container according to claim 14, wherein said plurality of welding portions are arranged on an edge portion of said cylindrical outer member at locally different pitches.

* * * * *

UNITED STATES PATENT AND TRADEMARK OFFICE

CERTIFICATE OF CORRECTION

PATENT NO. : 6,416,173 B2
DATED : July 9, 2002
INVENTOR(S) : Hajime Kishida et al.

It is certified that error appears in the above-identified patent and that said Letters Patent is hereby corrected as shown below:

Column 2,
Line 6, “of” should read -- of the --.

Column 5,
Line 6, “open” should read -- opened --.

Column 6,
Line 3, “SC” should read -- 5C --.

Column 10,
Line 41, “80,” should read -- 8º, --.

Column 11,
Line 45, “a n” should read -- an --;
Line 60, “present” should read -- present embodiment. --; and
Line 64, “extrusions” should read -- extrusion --.

Column 14,
Line 36, “walls said” should read -- walls of said --.

Column 15,
Line 4, “surf ace” should read -- surface --.

Signed and Sealed this

Fourth Day of February, 2003

JAMES E. ROGAN
*Director of the United States Patent and Trademark Office*